US008830135B2

(12) United States Patent
Dean et al.

(10) Patent No.: US 8,830,135 B2
(45) Date of Patent: Sep. 9, 2014

(54) DIPOLE ANTENNA ELEMENT WITH INDEPENDENTLY TUNABLE SLEEVE

(75) Inventors: Stuart James Dean, Kemptville (CA); Hafedh Trigui, Ottawa (CA); Lin-Ping Shen, Ottawa (CA); Alauddin Javed, Ottawa (CA)

(73) Assignee: Ultra Electronics TCS Inc., Montreal (CA)

( * ) Notice: Subject to any disclaimer, the term of this patent is extended or adjusted under 35 U.S.C. 154(b) by 345 days.

(21) Appl. No.: 13/398,504

(22) Filed: Feb. 16, 2012

(65) Prior Publication Data

US 2013/0214982 A1 Aug. 22, 2013

(51) Int. Cl.
*H01Q 9/28* (2006.01)

(52) U.S. Cl.
USPC ..... 343/795; 343/700 MS

(58) Field of Classification Search
CPC ..... H01Q 19/30; H01Q 21/26; H01Q 9/285
USPC ..... 343/700 MS, 793, 795, 797
See application file for complete search history.

(56) References Cited

U.S. PATENT DOCUMENTS

| | | | | |
|---|---|---|---|---|
| 5,598,174 | A * | 1/1997 | Erkocevic et al. | 343/795 |
| 5,936,583 | A | 8/1999 | Sekine et al. | |
| 6,018,324 | A * | 1/2000 | Kitchener | 343/795 |
| 6,337,666 | B1 | 1/2002 | Bishop | |
| 6,369,771 | B1 | 4/2002 | Chiang et al. | |
| 6,424,311 | B1 * | 7/2002 | Tsai et al. | 343/795 |
| 6,559,809 | B1 | 5/2003 | Mohammadian et al. | |
| 6,717,551 | B1 | 4/2004 | Desclos et al. | |
| 6,720,926 | B2 * | 4/2004 | Killen et al. | 343/700 MS |
| 6,734,828 | B2 | 5/2004 | Shor | |
| 6,741,219 | B2 | 5/2004 | Shor | |
| 6,747,605 | B2 | 6/2004 | Lebaric et al. | |
| 6,943,730 | B2 | 9/2005 | Poilasne et al. | |
| 6,961,028 | B2 | 11/2005 | Joy et al. | |
| 6,967,629 | B2 | 11/2005 | Cuthbert | |
| 7,050,014 | B1 | 5/2006 | Chen et al. | |
| 7,106,254 | B2 | 9/2006 | Jouvie et al. | |
| 7,248,227 | B2 * | 7/2007 | Chen | 343/795 |
| 7,339,529 | B2 * | 3/2008 | Martek | 343/700 MS |
| 7,403,160 | B2 | 7/2008 | Chiang et al. | |
| 7,411,552 | B2 | 8/2008 | King et al. | |
| 7,554,490 | B2 | 6/2009 | Baliarda et al. | |
| 7,911,405 | B2 | 3/2011 | Pascolini et al. | |
| 7,940,228 | B1 | 5/2011 | Buckley | |

(Continued)

FOREIGN PATENT DOCUMENTS

WO WO2008020249 2/2008

OTHER PUBLICATIONS

Yang et al., "Reflection Phase Characterizations of the EBG Ground Plane for Low Profile Wire Antenna Applications", IEEE Transactions on Antennas and Propagation, vol. 51, No. 10, Oct. 2003.

(Continued)

*Primary Examiner* — Tho G Phan
(74) *Attorney, Agent, or Firm* — Norton Rose Fulbright LLP

(57) ABSTRACT

There is described herein a low profile dipole antenna element. A pair of these elements can be arranged in a crossed manner to provide two orthogonal polarized radiators. The antenna element may be combined with an electrically conductive surface and a feed cable and connected to a feed source.

24 Claims, 9 Drawing Sheets

(56) References Cited

U.S. PATENT DOCUMENTS

| | | | |
|---|---|---|---|
| 2002/0024474 | A1 | 2/2002 | Chen |
| 2005/0237255 | A1 | 10/2005 | Zhang et al. |
| 2010/0127938 | A1 | 5/2010 | Ali et al. |
| 2010/0127943 | A1 | 5/2010 | Inoue et al. |
| 2010/0225554 | A1 | 9/2010 | Huang et al. |

OTHER PUBLICATIONS

Xie et al., "Design of a novel Artificial Magneric Conductor Place and its application for low-profile dipole", IEEE Xplore, retrieved from http://ieeexplore.ieee.org//xpls/abs_all.jsp?arnumber=5525228,Jun. 23, 2011.

Vardaxoglou et al., "Metamaterial based antennas with super- and substrates", IEEE Xplore, retrieved from http://ieeexlore.ieee.org/xpls/abs_all.jsp?arnumber=5068205, Jun. 23, 2011.

Al-Nuaimi, M., "Low profile dipole antenna design using square SRRs artificial ground place", IEEE Xplore, retrieved from http://ieeexplore.ieee.org/xpls/abs_all.jsp?arnumber=2483416, Jun. 23, 2011.

Bray et al., "A Broadband Open-Sleeve Dipole Antenna Mounted Above a Tunable EBG AMC Ground Plane", Antennas and Propagation Society International Symposium, Jun. 20-25, 2004, IEEE, 1147-1150, vol. 2.

Feresidis et al., "Artificial Magnetic Conductor Surfaces and Their Application to Low-Profile High-Gain Planar Antennas", IEEE Transactions on Antennas and propagation, vol. 53, No. 1, Jan. 2005.

Maloney et al., "Wide Scan, Integrated Printed Circuit Board, Fragmented Aperture Array Antennas", IEEE 2011, pp. 1965-1968.

* cited by examiner

TOP LAYER

BOTTOM LAYER

TOP LAYER

BOTTOM LAYER

DIPOLE ANTENNA ELEMENT WITH INDEPENDENTLY TUNABLE SLEEVE

CROSS-REFERENCE TO RELATED APPLICATIONS

This is the first application filed for the present invention.

TECHNICAL FIELD

The present invention relates to the field of wireless communications systems and other systems utilizing radiating electromagnetic fields. In particular the present invention relates to antenna elements suitable for both transmission and reception of electromagnetic radiation as a sole element or as part of an array of elements.

BACKGROUND OF THE ART

Traditionally, antenna elements have been designed using perfect electrical conductors often placed above a perfect electrically conducting ground-plane. A dipole element is typically utilized and spaced one quarter wavelength above the ground-plane. A perfect electrical conductor has the property that when an electromagnetic wave impinges on the surface it is reflected with a 180 degree change in phase. Thus if the dipole element is one quarter wavelength corresponding to a 90 degree phase shift then the reflected component has a 360 degree total phase change and is hence in phase with the radiating signal reinforcing radiation away from the ground-plane reflector. Small variations of the one quarter wavelength spacing are used to adjust the effective radiating beamwidth. This requirement for one quarter wavelength separation between the ground-plane and the radiating element limits the thickness of the antenna.

There is often a need to design low profile antennas. In some cases this can be met by using alternative elements such as patches. These elements do not always provide the necessary radiation patterns or other required characteristics. Therefore, alternative designs are desired.

SUMMARY

There is described herein a low profile dipole antenna element. A pair of these elements can be arranged in a crossed manner to provide two orthogonal polarized radiators. The antenna element may be combined with an electrically conductive surface and a feed cable and connected to a feed source.

In accordance with a first broad aspect, there is provided a planar dipole antenna element. The element comprises a substrate with a dielectric material having a first side and a second side; a first dipole element comprising a first conductive area on the first side of the substrate and a second conductive area on one of the first side and the second side of the substrate; a first transmission line on the first side of the substrate, the first transmission line having a first end connected to the second conductive area and a second end adapted for connection to a feed source; and a first sleeve on the second side of the substrate. The first sleeve comprises a third conductive area connected to the first conductive area at a first position and adapted for connection to a ground of the feed source at a second position, the distance between the first position and the second position corresponding to substantially one quarter wavelength, the first sleeve being substantially aligned on the second side of the substrate with the first conductive area on the first side of the substrate to provide a radiating function.

In accordance with a second broad aspect, there is provided a planar dipole antenna system. The system comprises a first antenna element comprising a substrate with a dielectric material having a first side and a second side; a first dipole element comprising a first conductive area on the first side of the substrate and a second conductive area on one of the first side and the second side of the substrate; a first transmission line on the first side of the substrate, the first transmission line having a first end connected to the second conductive area and a second end adapted for connection to a feed source; and a first sleeve on the second side of the substrate, the first sleeve comprising a third conductive area connected to the first conductive area at a first position and adapted for connection to a ground of the feed source at a second position, the distance between the first position and the second position corresponding to substantially one quarter wavelength, the first sleeve being substantially aligned on the second side of the substrate with the first conductive area on the first side of the substrate to provide a radiating function. The system also comprises an electrically conductive surface spaced from the antenna element and a first feed cable having a first end connected to the first antenna element at the second end of the first transmission line and grounded at the second position of the first sleeve, and a second end connected to the feed source.

Although the terms top and bottom sides are used throughout the description, the board may be mounted either way up, the utility of which will become apparent when a system comprising the antenna is described.

BRIEF DESCRIPTION OF THE DRAWINGS

Further features and advantages of the present invention will become apparent from the following detailed description, taken in combination with the appended drawings, in which.

It will be noted that throughout the appended drawings, like features are identified by like reference numerals.

DETAILED DESCRIPTION

Figure 1:
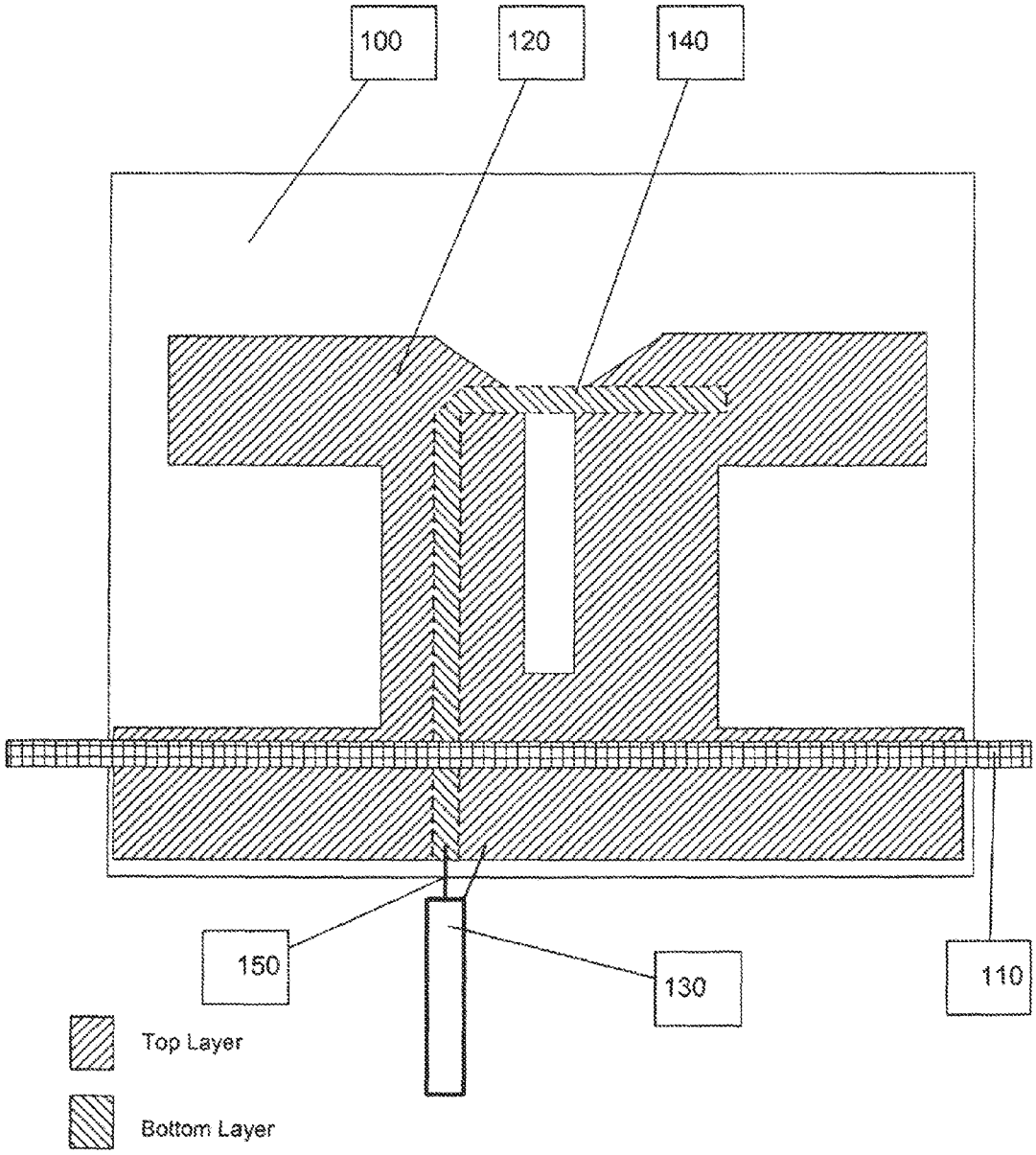
FIGURE 1 (PRIOR ART)
FIG. 1 is a schematic illustration of a dipole element as per the prior art.

FIG. 1 shows an example of a typical dipole element representing the prior art. The element comprises an etched circuit board 100 mounted perpendicularly to a large ground-plane 110 upon which a conductive area 120 of the form shown by the shading has been placed, commonly obtained by etching away the unwanted copper cladding on a layer of dielectric material. This copper area is connected to both the ground-plane 110 and an outer conductor of a coaxial cable feed 130. These elements are provided on a top layer of the etched circuit board. The second side (or bottom layer) of the element is shown where the centre conductor 150 of the coaxial cable feed is connected to a conductive area 140. Conductive area 140 acts as a balun to convert the unbalanced nature of the coaxial feed to the balanced nature of the dipole radiating element formed by conductive area 120. By adjustments to the length, width and position of the dipole shape 120 together with the balun 140, the characteristic impedance of both the dipole element and coaxial feed may be matched. This design requires a height from the ground-plane usually slightly in excess of one quarter wavelength.

Figure 2A:
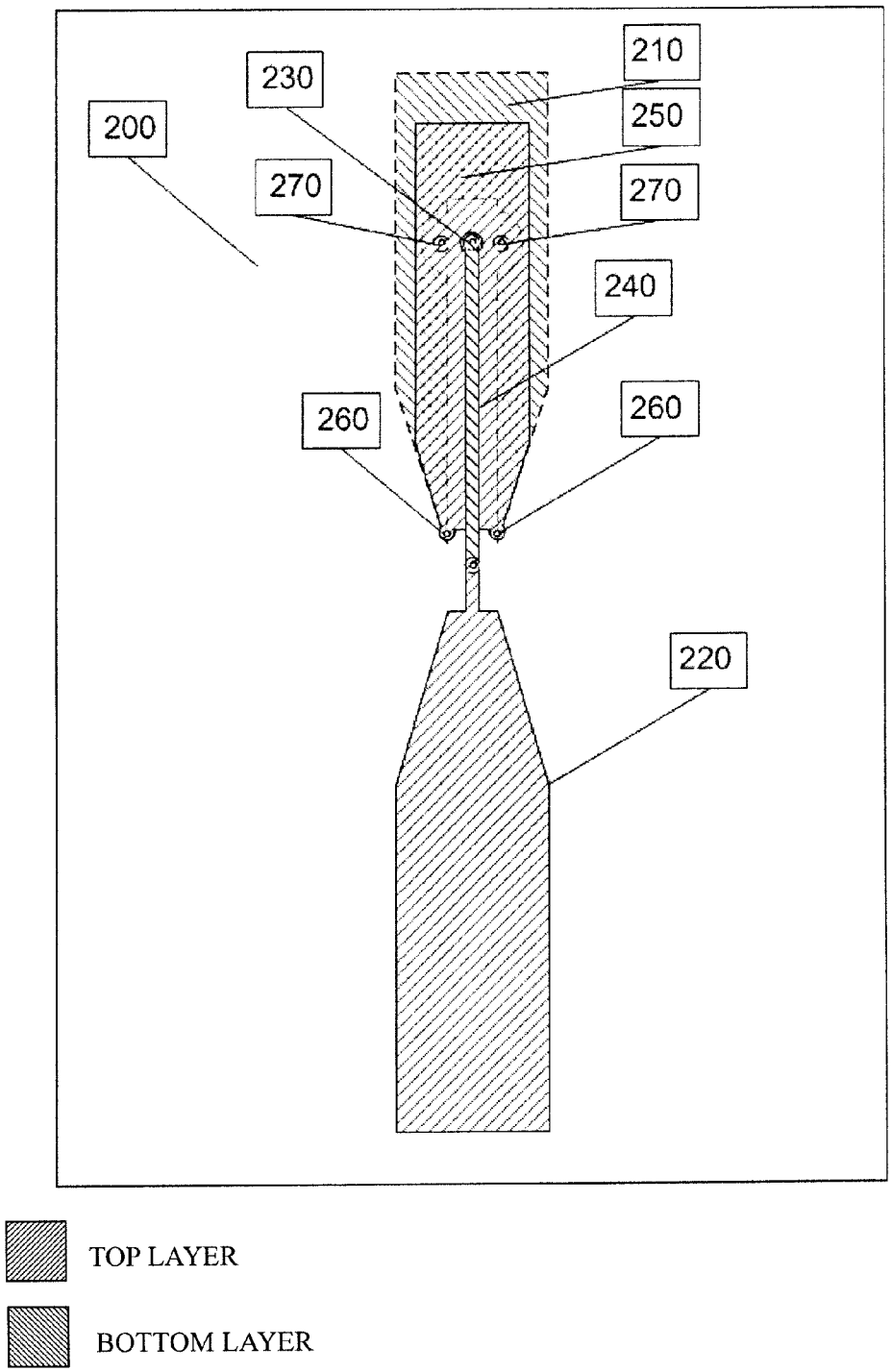
FIG. 2*a* is a schematic illustration of an examplary dipole element with an independently tunable sleeve where the two monopole elements are on opposite sides of a board.
Figure 2B:
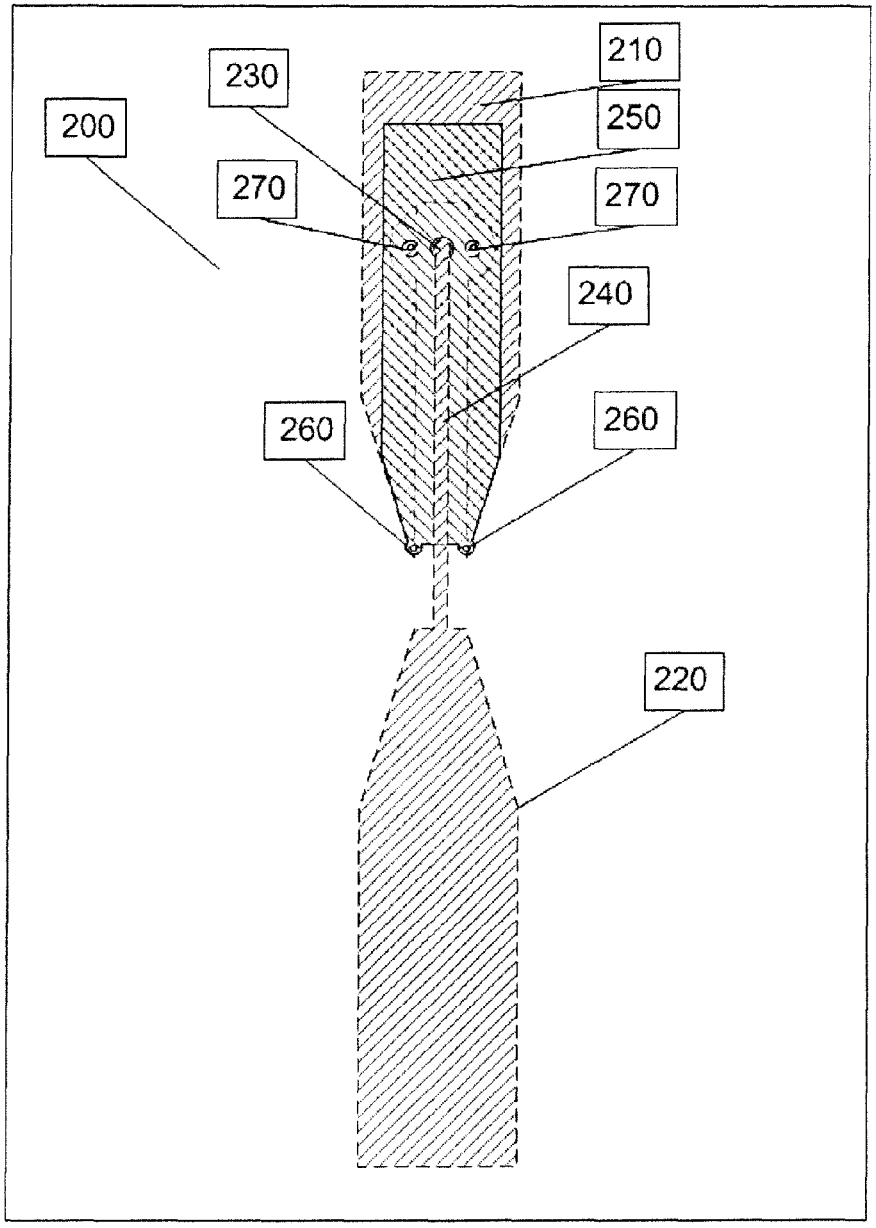
FIG. 2*b* is a schematic illustration of an examplary dipole element with an independently tunable sleeve where the two monopole elements are on a same side of a board.

FIGS. 2*a* and 2*b* illustrate exemplary embodiments of an antenna element with a balun arrangement that is implemented such that the element can be parallel to the ground-plane rather than orthogonal. This balun arrangement allows for some reduction in height when used in isolation. The dipole element comprises of an etched copper circuit board 200. As per FIG. 2*b*, on one side of this circuit board conductive areas 210 and 220 are etched to form a dipole element. The conductive part 240 of area 220 from the centre-line to its connection point to the element feed 230 is nominally a one quarter wavelength long transmission line section of suitable impedance to match the dipole to a feed network when adjusted for the dielectric constant of the supporting circuit board 200.

The line may be considered to be of micro-strip form. The dielectric loading of this micro-strip line section means that the quarter wavelength section is significantly shorter than the quarter wavelength in free space used to determine the element dimensions. The exact dimensions are adjusted to achieve the desired performance characteristics. The distance from the top edge of conductive area 210 to the bottom edge of conductive area 220 may be nominally one half wavelength in free space. The second side of the circuit board 200 comprises a grounded conductive area 250 somewhat less than the quarter wavelength of conductive area 210. This area 250 may be connected to conductive area 210 using connection points 260, such as vias, and serves as a sleeve. This sleeve has two purposes. Firstly, it acts as a ground-plane for the transmission line 240. With this ground-plane in place, the transmission line 240 now acts as a balun to connect the balanced nature of the dipole element to the unbalanced nature of the feed network. The second function of sleeve 250 is to act as a radiating sleeve and expand the bandwidth of the radiating element comprising of areas 210 and 220 forming a dipole radiator. The length of the sleeve 250 from the connection points 260 can be varied to adjust the antenna bandwidth as desired within limits providing it is always longer than the dielectrically loaded quarter wavelength required for the balun. Ground points 270 may be provided on the sleeve. Connection feed-point 260 may be connected to the centre conductor of a coaxial cable feed, the outer conductor of which is connected to ground-points 270. Alternatively the appropriate selection of conductor diameters and spacing of the parallel line feed can be implemented to connect the antenna to a feed network.

As per FIG. 2*a*, conductive area 220 may also be provided on an opposite surface to conductive area 210. In this embodiment, a first monopole is present on surface one and a second monopole is present on surface two. Together, the first monopole and the second monopole form the dipole. The sleeve 250 is provided on the same surface as the second conductive area 220, in an overlapping relation with respect to conductive area 210. In both embodiments illustrated, the sleeve 250 is independent of the dipole and can be tuned to obtain an increased bandwidth for a given match level.

Figure 3A:
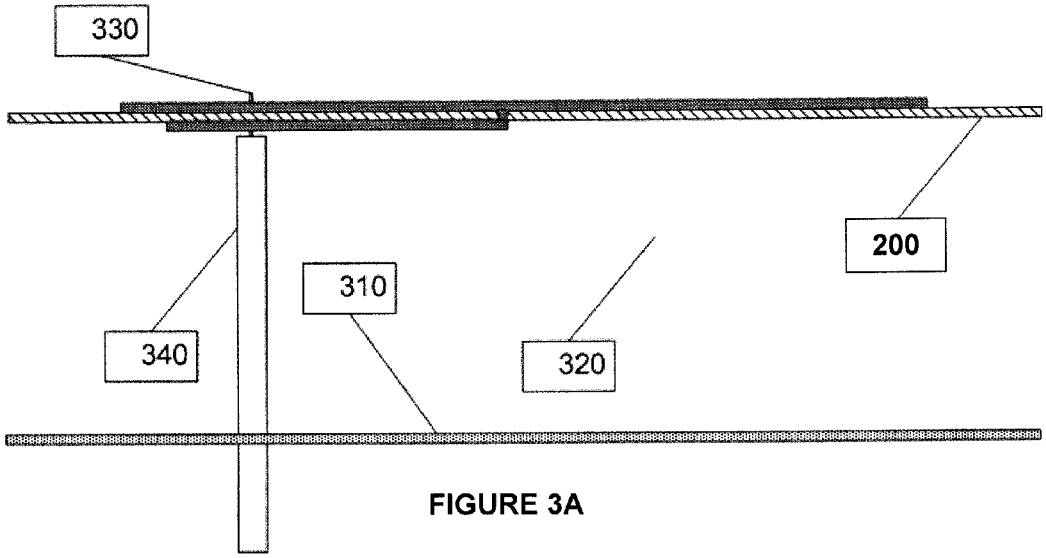
FIG. 3*a* is a side view of an examplary feed network for the dipole element with an independently tunable sleeve as per FIGS. 2*a* and 2*b;*
Figure 3B:
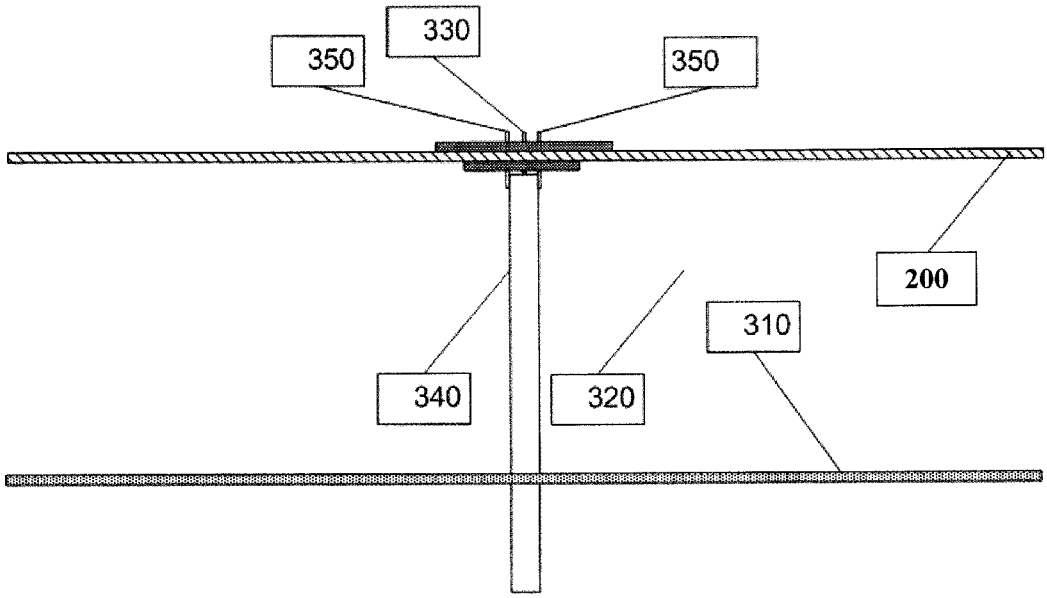
FIG. 3*b* is a front view of an examplary feed network for the dipole element with an independently tunable sleeve as per FIGS. 2*a* and 2*b;*

FIGS. 3*a* and 3*b* illustrate an exemplary embodiment for a feed network to be used with the antenna element of FIG. 2*a* or 2*b*. The side view of FIG. 3*a* shows the circuit board 200 mounted nominally one quarter wavelength above an electrically conductive ground plane 310. The precise spacing is determined by the required radiation pattern in manners well known to practitioners of the art. Space 320 may be left unfilled, or alternatively, it may be filled with dielectrics such as foam. Whilst other dielectrics with higher dielectric constants may be used, they are usually precluded by surface mode effects degrading the radiation pattern and or efficiency. A centre conductor 330 of the coaxial cable 340 is connected to the circuit board 300 at point 240 shown in FIGS. 2*a* and 2*b*. The front view of FIG. 3*b* shows conductors 350 which may be used to connect the outer conductor of the feed coax connected to conductive area 250 at the points 260. The diameter of these connecting conductors together with their spacing is adjusted to match the characteristic impedance of the feed cable using methods well known to practitioners of the art.

In an alternative embodiment, the conductive ground-plane 310 is replaced with a Perfect Magnetic Conductor (PMC) or Electromagnetic Band-Gap (EBG) surface. An EBG reflector exhibits a frequency dependant reflection phase passing through zero degrees at the band-gap centre. This enables the space 320 to be considerably narrowed. Whilst in theory the spacing could be reduced to zero, in practice the spacing is often chosen to be around one tenth to one fifteenth of a wavelength or less. Using the dipole elements illustrated in FIGS. 2*a* and 2*b*, this enables a reduction in the depth of the antenna using air or foam spacing. In addition, the provision of an EBG surface can significantly reduce the transmission of surface waves, thus improving the front to back ratio of the radiated pattern for a given size ground-plane. Alternatively, the size of the ground-plane may be reduced for any given performance required, thus improving both radiation patterns and radiated efficiency. Solid dielectric may be substituted for the air or foam in this embodiment. In some cases the spacing between the dipole and the PMC surface is minimized to ensure the suppression of surface wave propagation which, has been shown to reduce the element gain by 3 dB or more. A spacing of 1/120 wavelengths has been shown to have minimal gain loss when compared with an element ¼ wavelength above a PMC ground-plane element.

Figure 4:
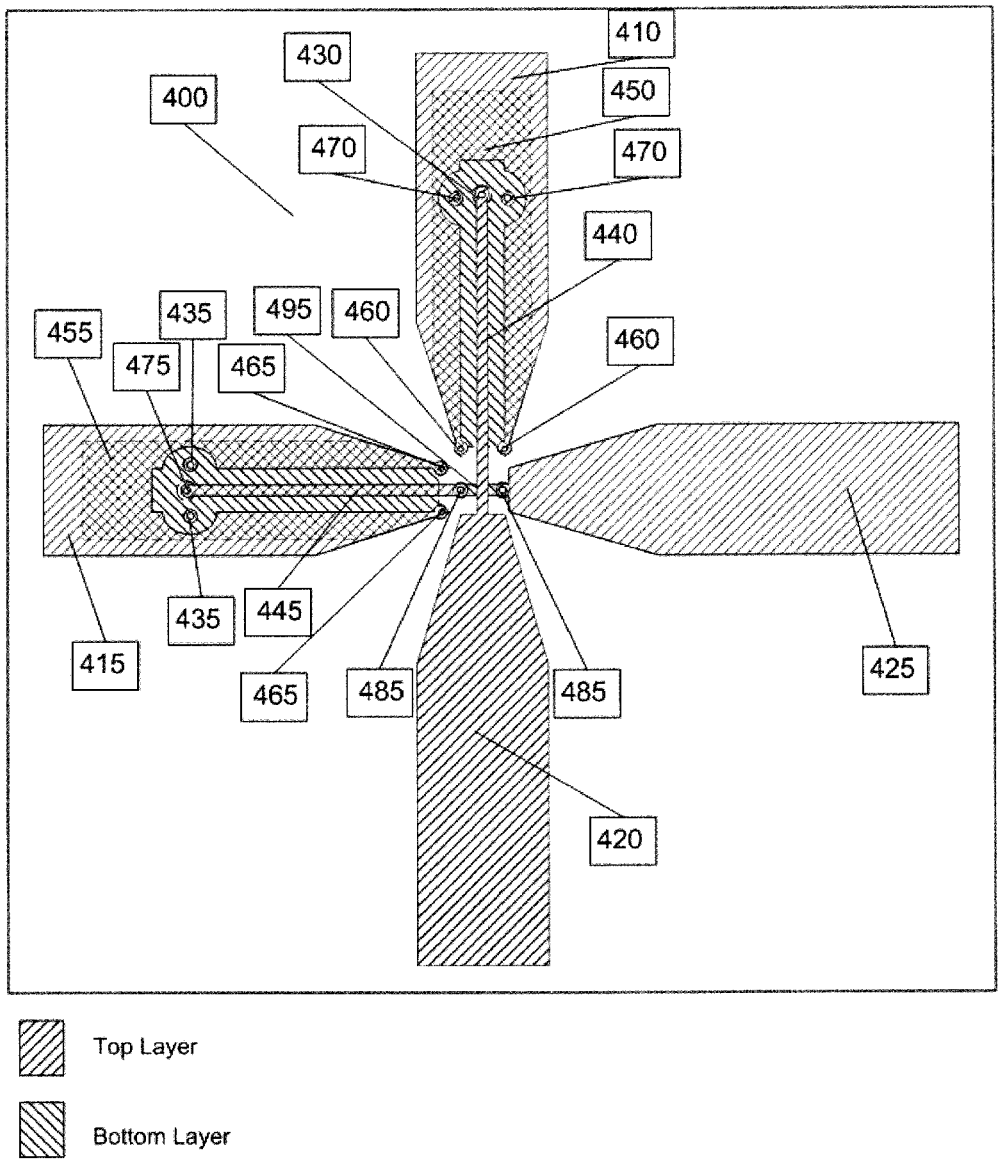
FIG. 4 is a schematic of an examplary antenna element with two dipoles on a same board.

FIG. 4 illustrates another embodiment for the dipole element with independently tunable sleeve, whereby two orthogonal polarized elements are provided within the same space. The first dipole element comprises an etched copper circuit board 400. On a first side of this circuit board, conductive areas 410 and 420 are etched to form a dipole element. The conductive part 440 of area 420, from the centre-line to its connection point at the element feed 430, is a nominally one quarter wavelength long transmission line section of suitable impedance to match the dipole to a feed network. In some embodiments, the line may be of micro-strip form. The exact dimensions are adjusted to achieve the desired performance characteristics. The distance from the top edge of conductive area 410 to the bottom edge of conductive area 420 being nominally one half wavelength in free space.

The second side of the circuit board 400 comprises a grounded conductive area 450 somewhat less than one quarter wavelength. This area is connected to conductive area 410 using vias 460 and represents the sleeve, which acts as a ground-plane for the transmission line 440. With this ground-plane in place, the transmission line now acts as a balun to connect the balanced nature of the dipole element to the unbalanced nature of the feed network. The sleeve also acts as a radiating sleeve to expand the bandwidth of the radiating element comprising of areas 410 and 420 forming a dipole radiator. The length of this conductive area 450 from the connection points 460 can be varied to adjust the antenna bandwidth as desired within limits, providing it is always longer than the dielectrically loaded quarter wavelength required for the balun. Ground points 470 are provided on the sleeve. Connection feed-point 460 can be connected to the centre conductor of a coaxial cable feed, the outer conductor of which is connected to ground-points 470.

Alternatively, by appropriate selection of conductor diameters and spacing, a parallel line feed can be implemented to connect the antenna to the feed network. A second dipole element is also etched on the copper circuit board 400, orthogonal to the first dipole element. On the first side of the circuit board 400 conductive areas 415 and 425 are etched to form the second dipole element. The conductive part 445 of area 425, from the centre-line to its connection point at the element feed 435, is a nominally one quarter wavelength long transmission line section of suitable impedance to match the dipole to the feed network. The distance from the left edge of conductive area 415 to the right edge of conductive area 425 may be nominally one half wavelength in free space.

The second side of the circuit board 400 comprises a grounded conductive area 455 somewhat less than one quarter wavelength. This area is connected to conductive area 415 using vias 465 and serves as the sleeve for the second dipole element. The sleeve acts as a ground-plane for the transmission line 445 and as a radiating sleeve to expand the bandwidth of the radiating element comprising of areas 415 and 425 forming the dipole radiator. The length of this conductive area 455 can be varied to adjust the antenna bandwidth as desired within limits, providing it is always longer than the dielectrically loaded quarter wavelength required for the balun. Ground points 475 are provided on the sleeve. Connection feed-point 465 can be connected to the centre conductor of a second coaxial cable feed, the outer conductor of which is connected to ground-points 475.

Alternatively, by appropriate selection of conductor diameters and spacing, a parallel line feed can be implemented to connect the antenna to a feed network. In this implementation conductive area 425 has been separated from conductive area 445 by a crossover bridge comprising a conductive track 495 having the same width as conductive area 445 and printed on the second side of circuit board 400. Conductive areas 425, 445 and 495 are connected using vias 485. Alternatively the sides of the board used for creating this orthogonal dipole may be reversed, eliminating the need for the crossover bridge. This alternative embodiment requires that the two dipoles be individually adjusted to compensate for performance differences when mounted above a ground-plane, be it a perfect electrical or magnetic conductor. Also alternatively, the monopoles of each dipole may be provided on opposite sides of the board, as per the embodiment of FIG. 2*a*.

Figure 5A:
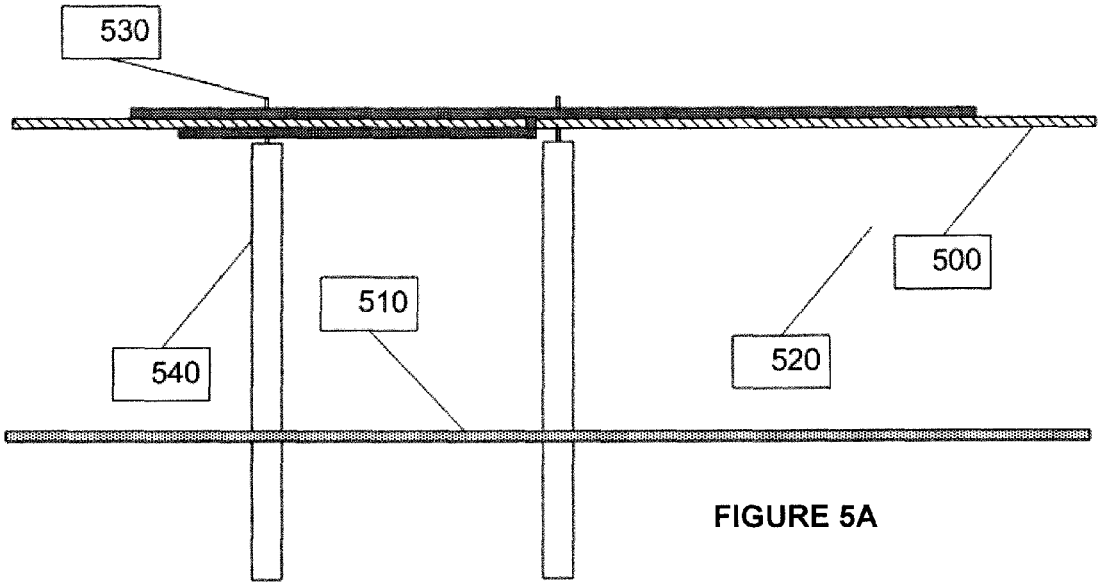
FIG. 5*a* is a side view of an examplary feed network for the dipole element with an independently tunable sleeve as per FIG. 4.
Figure 5B:
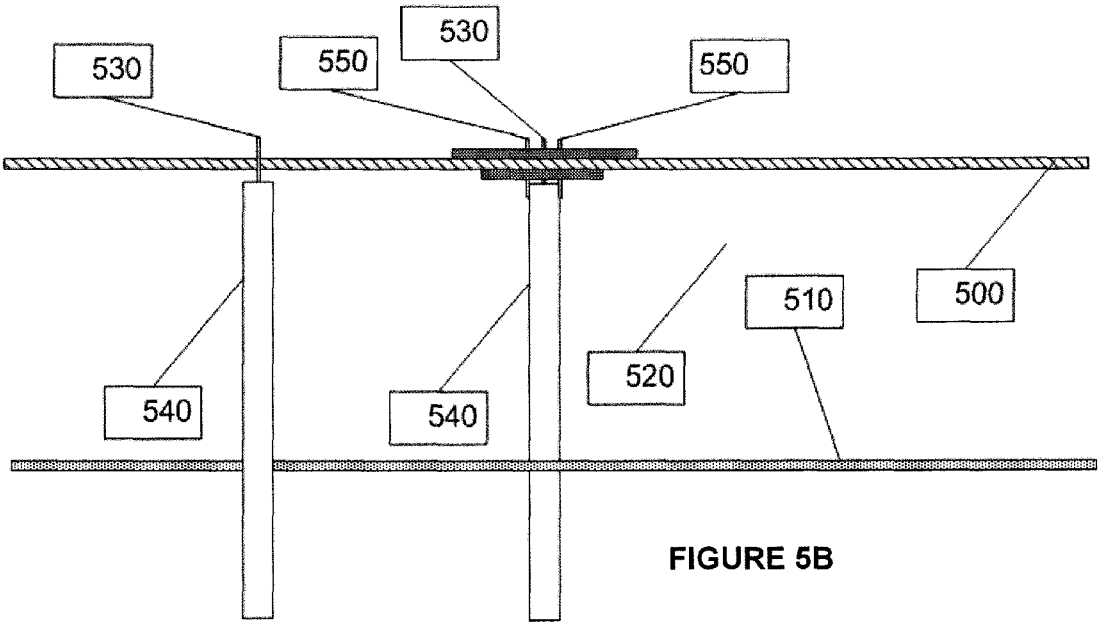
FIG. 5*b* is a front view of an examplary feed network for the dipole element with an independently tunable sleeve as per FIG. 4.

FIGS. 5*a* and 5*b* illustrate side and front views, respectively, of the antenna element of FIG. 4 connected to a feed network. The circuit board 500 is mounted nominally one quarter wavelength above an electrically conductive ground-plane 510. The precise spacing is determined by the required radiation pattern. Space 520 may be left unfilled or it may be filled with dielectrics, such as foam. Whilst other dielectrics with higher dielectric constants may be used, they are usually precluded by surface mode effects degrading the radiation pattern and/or efficiency. The centre conductor of the coaxial cable 540 is connected to the element balun 445 at point 475 as shown in FIG. 4. The outer conductor of the feed coax 540 is connected to dipole sleeve conductive area 455 at the points 435 as shown in FIG. 4. The diameter of these connecting conductors together with their spacing is adjusted to match the characteristic impedance of the feed cable. A second coaxial feed 540 is similarly connected to the second dipole element which is orthogonal to the first dipole element. Similarly to the feed network of FIGS. 3*a* and 3*b*, the conductive ground-plane may be replaced with PMC or an EBG with the appropriate space 520. Also alternatively, the size of the ground-plane may be reduced for any given performance required, thus improving both radiation patterns and radiated efficiency. Solid or perforated dielectric may be substituted for the air or foam in this implementation.

Figure 6:
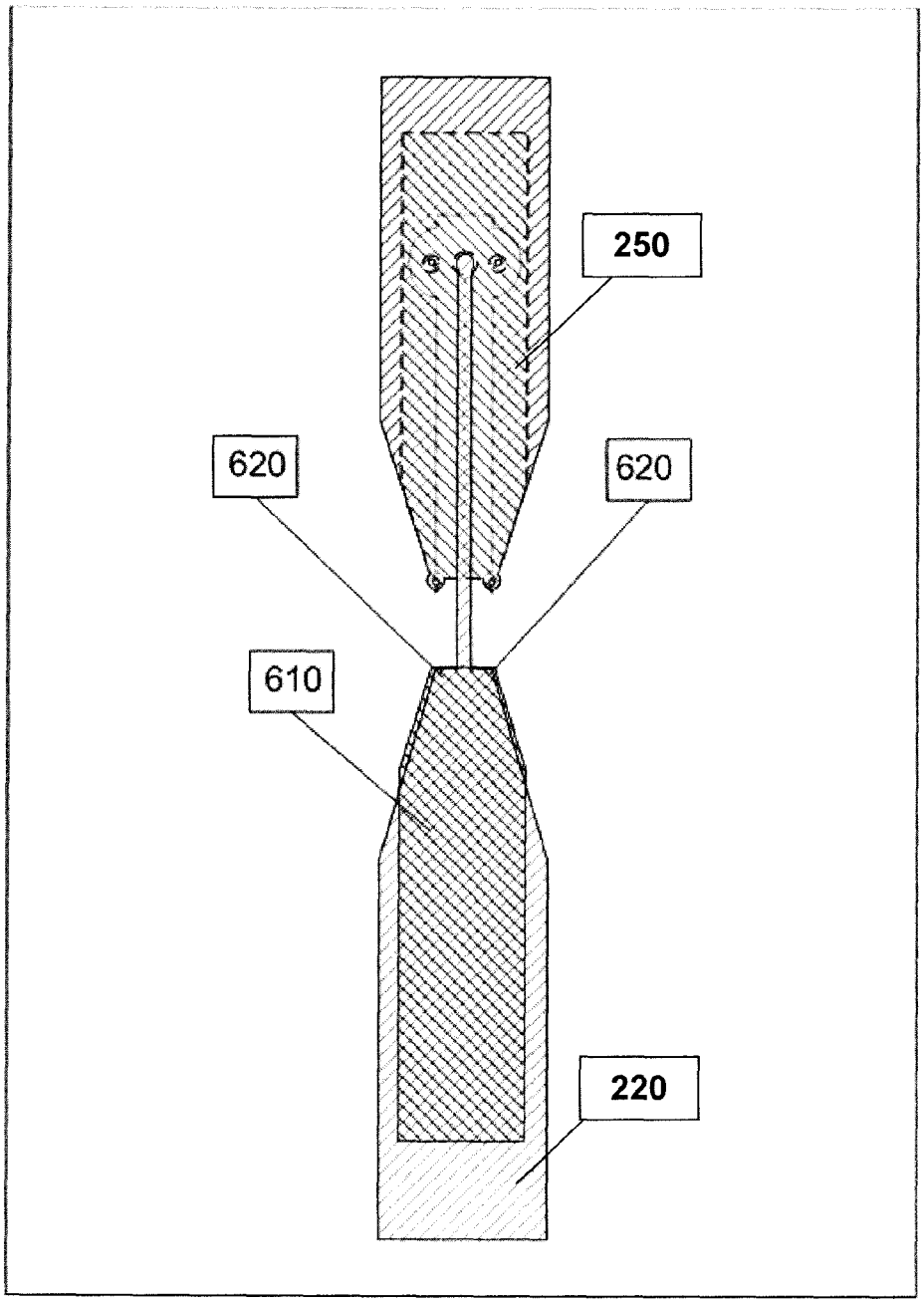
FIG. 6 is a schematic illustration of an examplary dipole element with an independently tunable sleeve with a balancing sleeve.

In another embodiment, an additional conductive area is added to the dipole element, as illustrated in FIG. 6. Conductive area 610 balances the sleeve 250 and may be referred to as a balancing sleeve. The balancing sleeve 610 may be left floating as shown, or connected to the dipole element 220 using vias located at points 620. This same modification can be applied to the embodiments illustrated in FIGS. 2*a*, 2*b*, and 4. This modification may be particularly applicable when the elements described are to be used in an arrayed form. For a given return loss, the bandwidth may be further extended by the extra sleeve elements. Alternatively the additional sleeves may provide an improved return loss response for a given bandwidth.

Figure 7A:
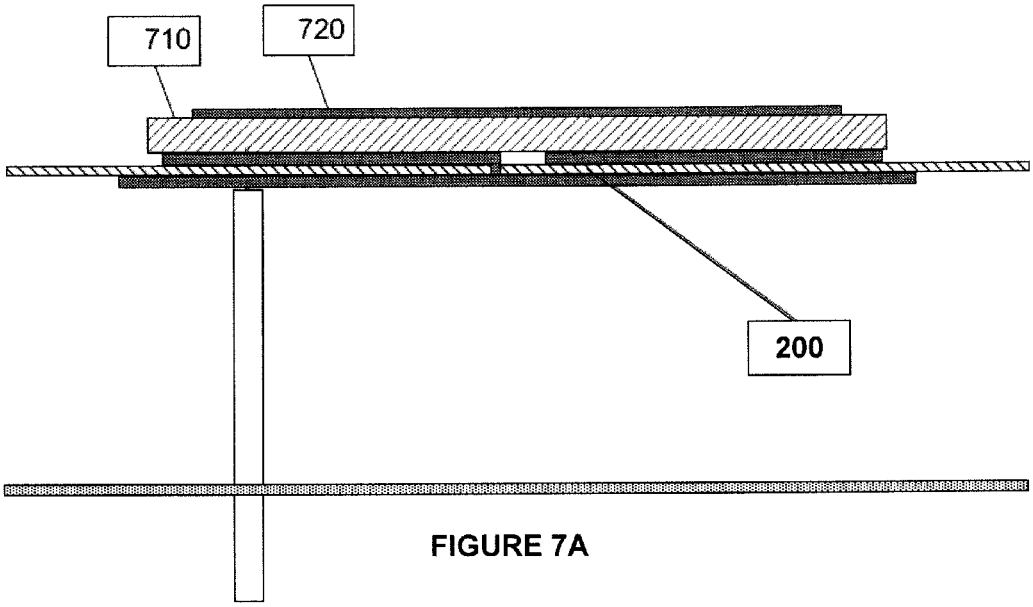
FIG. 7*a* is a side view of an examplary feed network for the dipole element with an independently tunable sleeve with a balancing sleeve.
Figure 7B:
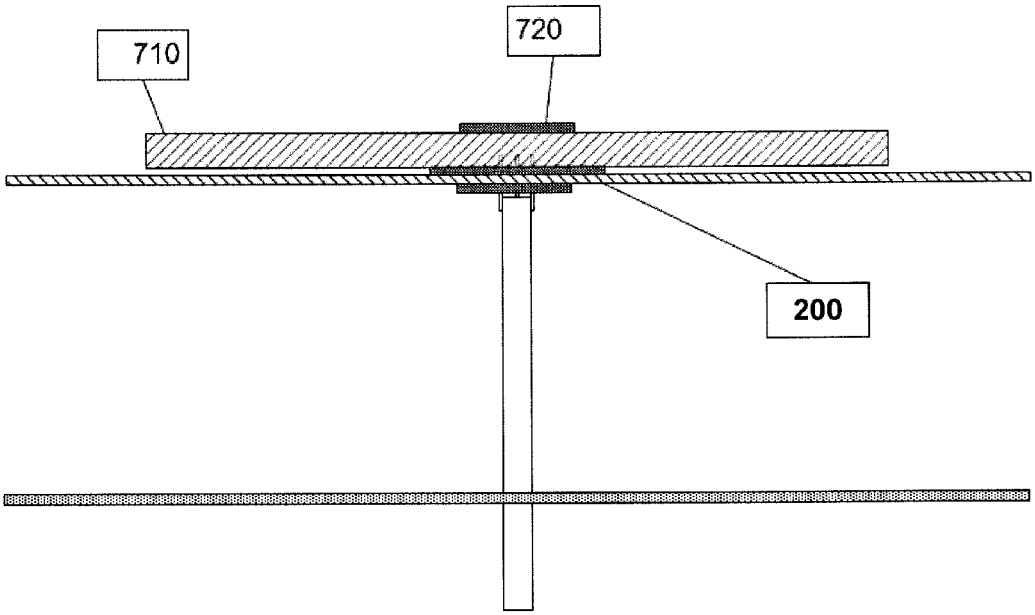
FIG. 7*b* is a front view of an examplary feed network for the dipole element with an independently tunable sleeve with a balancing sleeve.

FIGS. 7*a* and 7*b* show a dipole antenna element with an additional sleeve 720 incorporated into a feed network. The additional sleeve 720 is laid over the element from which it is separated by a spacer 710. The spacer 710 may comprise of air, foam, perforated or solid dielectric.

Figure 8:
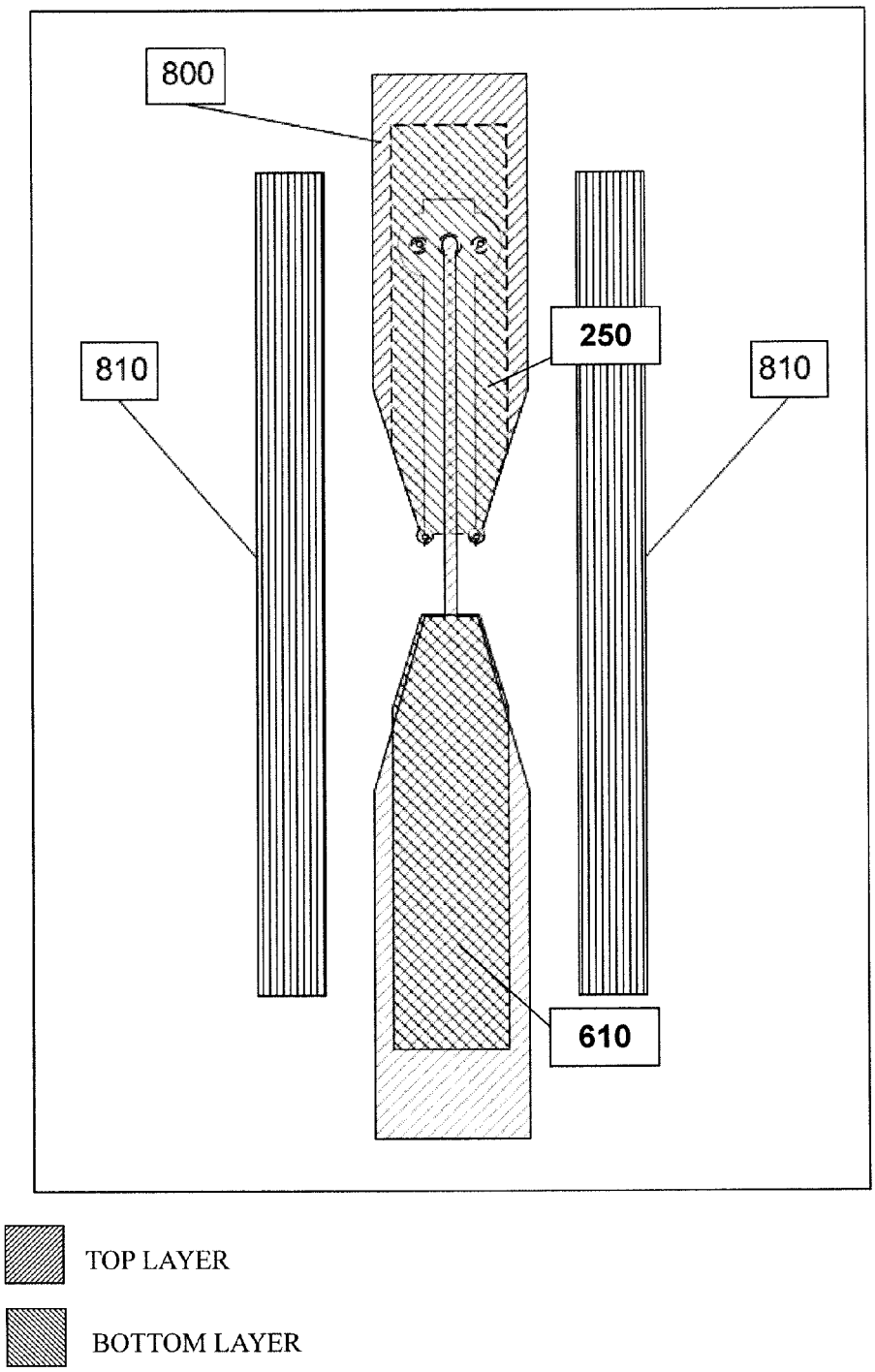
FIG. 8 is a schematic illustration of an examplary dipole element with an independently tunable sleeve of FIG. 6 with an additional pair of symmetrical balancing sleeves.

In another alternative embodiment for the dipole element, a further additional balancing sleeve 810 may also be placed alongside the element 800, as per FIG. 8. In this case, a pair of identical balancing sleeves 810 are used in addition to the first balancing sleeve 610, to avoid squinting of the radiation pattern. Various other embodiments for having the low profile antenna with an independent sleeve will be understood by those skilled in the art. Such embodiments will allow the sleeve to be tunable in order to achieve a desired bandwidth. For example, only the pair of sleeves 810 are provided without balancing sleeve.

The size and spacing of the sleeve and balancing sleeves may be varied to set the filtering characteristics of the dipole antenna element as desired. In addition, the thickness of the board 200 may be varied to obtain a given coupling. The embodiments of the invention described above are intended to be exemplary only. The scope of the invention is therefore intended to be limited solely by the scope of the appended claims.

The invention claimed is:

1. A planar dipole antenna element comprising:

a substrate with a dielectric material having a first side and a second side;

a first dipole element comprising:

a first conductive area on the first side of the substrate; and a second conductive area on one of the first side and the second side of the substrate;

a first transmission line on the first side of the substrate, the first transmission line having a first end connected to the second conductive area and a second end adapted for connection to a feed source; and a first sleeve on the second side of the substrate, the first sleeve comprising a third conductive area connected to the first conductive area at a first position and adapted for connection to a ground of the feed source at a second position, the distance between the first position and the second position corresponding to substantially one quarter wavelength, the first sleeve being substantially aligned on the second side of the substrate with the first conductive area on the first side of the substrate to provide a radiating function.

2. The planar dipole antenna element of claim 1, wherein the second conductive area is on the second side of the substrate and wherein the first transmission line extends from the second conductive area.

3. The planar dipole antenna element of claim 1, wherein the first conductive area comprises a cutout portion and the first transmission line extends inside the cutout portion of the first conductive area.

4. The planar dipole antenna element of claim 1, wherein the first conductive area and the second conductive area have a substantially same outer shape.

5. The planar dipole antenna element of claim 4, wherein the second conductive area is positioned on the substrate as a mirror image of the first conductive area.

6. The planar dipole antenna element of claim 1, wherein at least one of the first conductive area and the second conductive area is paddle-blade shaped.

7. The planar dipole antenna element of claim 1, wherein the first transmission line is of micro-strip form.

8. The planar dipole antenna element of claim 1, wherein the third conductive area is smaller than the first conductive area.

9. The planar dipole antenna element of claim 1, further comprising a second dipole element, a second transmission line, and a second sleeve, on the substrate and positioned substantially orthogonally to the first dipole element, the first transmission line, and the first sleeve.

10. The planar dipole antenna element of claim 9, wherein the second dipole element, second transmission line, and second sleeve are substantially identical in size and shape to the first dipole element, the first transmission line, and the first sleeve.

11. The planar dipole antenna element of claim 1, further comprising a balancing sleeve on the first side of the substrate, the balancing sleeve comprising a fourth conductive area substantially aligned on the first side of the substrate with the second conductive area on the second side of the substrate.

12. The planar dipole antenna element of claim 11, wherein the balancing sleeve is connected to the second conductive area.

13. The planar dipole antenna element of claim 11, wherein the balancing sleeve is separated from conductive areas on the first side of the substrate by a spacer.

14. The planar dipole antenna element of claim 11, wherein the balancing sleeve is shaped to correspond to the first sleeve.

15. The planar dipole antenna element of claim 1, further comprising at least one balancing sleeve positioned on one of the first side and the second of the substrate alongside the first dipole element.

16. The planar dipole antenna element of claim 15, wherein the at least one balancing sleeve comprises a pair of balancing sleeves placed on each side of the first dipole element along a length thereof.

17. A planar dipole antenna system comprising:

a first antenna element comprising a substrate with a dielectric material having a first side and a second side;

a first dipole element comprising:

a first conductive area on the first side of the substrate; and a second conductive area on one of the first side and the second side of the substrate;

a first transmission line on the first side of the substrate, the first transmission line having a first end connected to the second conductive area and a second end adapted for connection to a feed source; and a first sleeve on the second side of the substrate, the first sleeve comprising a third conductive area connected to the first conductive area at a first position and adapted for connection to a ground of the feed source at a second position, the distance between the first position and the second position corresponding to substantially one quarter wavelength, the first sleeve being substantially aligned on the second side of the substrate with the first conductive area on the first side of the substrate to provide a radiating function;

an electrically conductive surface spaced from the antenna element; and a first feed cable having a first end connected to the first antenna element at the second end of the first transmission line and grounded at the second position of the first sleeve, and a second end connected to the feed source.

18. The planar dipole antenna system of claim 17, wherein a space between the antenna element and the electrically conductive ground plane is unfilled.

19. The planar dipole antenna system of claim 17, wherein a space between the antenna element and the electrically conductive ground plane comprises a dielectric material.

20. The planar dipole antenna system of claim 17, wherein the feed cable is a coaxial cable having a center conductor connected to the second end of the transmission line and an outer conductor connected to the second position of the sleeve.

21. The planar dipole antenna system of claim 17, wherein the electrically conductive surface is a ground plane space substantially one quarter wavelength from the antenna element.

22. The planar dipole antenna system of claim 17, wherein the electrically conductive surface is one of a perfect magnetic conductor and an electromagnetic band-gap surface.

23. The planar dipole antenna system of claim 22, wherein the electrically conductive surface is spaced less than or equal to about one tenth of a wavelength from the antenna element.

24. The planar dipole antenna system of claim 17, further comprising a second antenna element substantially corresponding to the first antenna element and positioned orthogonally thereto on the substrate, and a second feed cable having a first end connected to the second antenna element at a second end of a second transmission line and grounded at a second position of a second sleeve, and a second end connected to the feed source.

* * * * *